United States Patent [19]

Obregon

[11] 3,944,085

[45] Mar. 16, 1976

[54] UNDERGROUND AUTOMATIC PARKING SYSTEM FOR VEHICLES

[76] Inventor: Alejandro Obregon, Horacio 543-403, Mexico City, Mexico

[22] Filed: Aug. 19, 1974

[21] Appl. No.: 498,520

[52] U.S. Cl. ..... 214/16.1 C; 214/16.4 R

[51] Int. Cl.[2] ..... E04H 6/06

[58] Field of Search... 214/16.1 R, 16.1 C, 16.1 CB, 214/16.1 E, 16.4 R; 187/28–29

[56] References Cited

UNITED STATES PATENTS

| | | | |
|---|---|---|---|
| 3,180,500 | 4/1965 | Alimanestianu et al. | 214/16.1 CB |
| 3,279,626 | 10/1966 | De Roumefort | 214/16.1 CB |
| 3,866,766 | 2/1975 | Klaus | 214/16.1 E |

FOREIGN PATENTS OR APPLICATIONS

| | | | |
|---|---|---|---|
| 1,279,309 | 10/1968 | Germany | 214/16.1 C |

*Primary Examiner*—Robert J. Spar
*Assistant Examiner*—R. B. Johnson
*Attorney, Agent, or Firm*—Imirie, Smiley & Linn

[57] ABSTRACT

An underground automatic parking system has a vertical well with two spaced elongated vertical side compartments each having a plurality of parking spaces. An elevator with a car transfer mechanism is located between the compartments. A plurality of slides are arranged in the parking spaces. Each slide has two side headers of triangular form and a rectangular frame which supports a corresponding plurality of vehicle carrying platforms. The slides are horizontally displaceable on tracks arranged along the ends of each parking space of the well between a retracted position within one of the side compartments and an extended position to intersect the path of the transfer mechanism on the elevator.

18 Claims, 17 Drawing Figures

UNDERGROUND AUTOMATIC PARKING SYSTEM FOR VEHICLES

BACKGROUND OF THE INVENTION

The present invention refers to a parking system for vehicles and, more particularly, it is related to a fully automatic underground parking system for vehicles, which is quite unconspicuous and does not interfere with the normal traffic on the streets.

It is a very well known fact all over the world that the parking of vehicles in predetermined areas of large cities is a particularly difficult problem, moreso when areas of great commercial activities are considered, because there is an extraordinary flow of vehilces into and out of said areas, which creates a very high traffic density which does not allow for parking vehicles on the streets. On the other hand, the parking systems of the prior art have left much to desire and are absolutely inefficient. In effect, when said systems merely comprise large lots of land wherein the vehicles are accommodated in a completely disorganized manner, a numerous personnel is required to drive the vehicles and statistics show that accidents and burglary are quite frequent in this type of parking lots. Prior art parking systems consisting of buildings of several floors wherein entrance and exit ramps are built for the transit of vehicles, are also quite disadvantageous in that the vehicles are normally spoiled by the personnel in charge of said parking buildings when the vehicles are driven up and down the ramps. While in some parking buildings having several parking floors, elevator systems have been provided, nevertheless the vehicles have to be driven by a person whose ability is rather doubtful and who does not care too much about what may occur to the mechanisms of the vehicle when driving the same.

Therefore, for long a solution has been sought to solve the problem of lack of fully automatic parking systems in which, once the owner of the vehicle applies for the services of the establishment, he can leave his vehicle locked, as it will not be driven by the personnel in charge of the parking system.

On the other hand, the prior art parking buildings require a substantial area of land and must be built where perhaps more profitable buildings could be built instead.

The prior art has also provided underground parking systems, but these merely comprise a basement or the like, in which all the vehicles are placed by drivers, also in a completely disorganized manner which does not solve the problem of parking vehicles in heavy traffic areas of a city.

On the other hand, in railroad yards, very numerous and complicated maneuvers are necessary to park railroad cars and to thereafter form trains with the same, whereby very large extensions of land are occupied and very complicated networks of tracks and branches are necessary to carry out said operations, whereby a railroad car efficient parking system does not exist which may fully solve the above mentioned serious problems.

SUMMARY OF THE INVENTION

Having in mind the defects of the prior art parking systems for vehicles, the present invention provides an underground, fully automatic parking system for vehicles, which overcomes all the disadvantages of the prior art parking systems and avoids the necessity of driving the vehicles within the parking space by uncapable personnel.

The present invention also provides an undergroung parking system for vehicles, of the above mentioned character, in which the vehicles are placed in different parking spaces by mechanical means which are fully automatic and do not need the intervention of personnel to drive said vehicles.

This invention also provides an underground parking system for vehicles, of the above described character, which in spite of being fully automatic, is very easy to build and very efficient to operate.

The present invention also provides an underground parking system for vehicles, of the above mentioned character, which provides for the simultaneous operation of accommodating a vehicle in an empty parking space and removing another vehicle from an occupied parking space in the same trip of an elevator, in a time which is very short as compared to the time normally involved in accommodating a vehicle in and removing another vehicle from a parking space of any prior art parking system.

This invention also provides an underground parking system for vehicles, of the above mentioned characteristics, which is capable of a completely underground installation, in order to avoid interference with the normal traffic on the streets or railroad yards or with the pedestrians walking on side-walks and on parks.

The present invention also provides a vehicle parking system of the above mentioned character, which is admirably adapted to be associated to an apartment building and will be capable of introducing and removing vehicles such as automobiles in a fully automatic manner by the simple actuation of a key within a lock.

The present invention also provides a vehicle parking system of the above described character, which is also very well adapted to automatically park non self-driven vehicles such as railroad cars in a railraod yard, thus avoiding the provision of very complicated networks for maneuvers.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of a specific embodiment, when read in connection with the accompanying drawings, in which:

FIG. 13 is a side elevational view of said platform;

FIG. 14 is a front elevational view of said platform;

DETAILED DESCRIPTION

Figure 1:
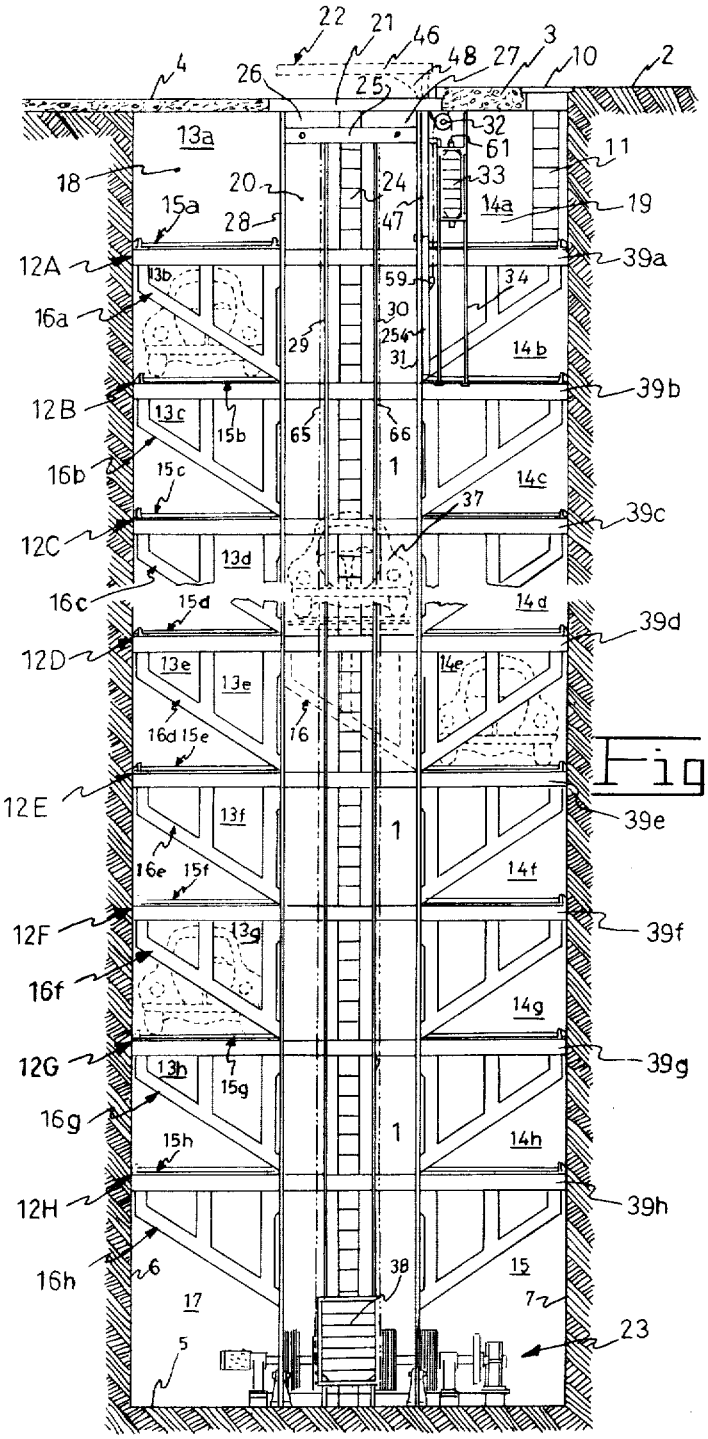
FIG. 1 is an elevational front cross-sectional view of a fully automatic underground parking system for vehicles, built in accordance with the present invention.
Figure 2:
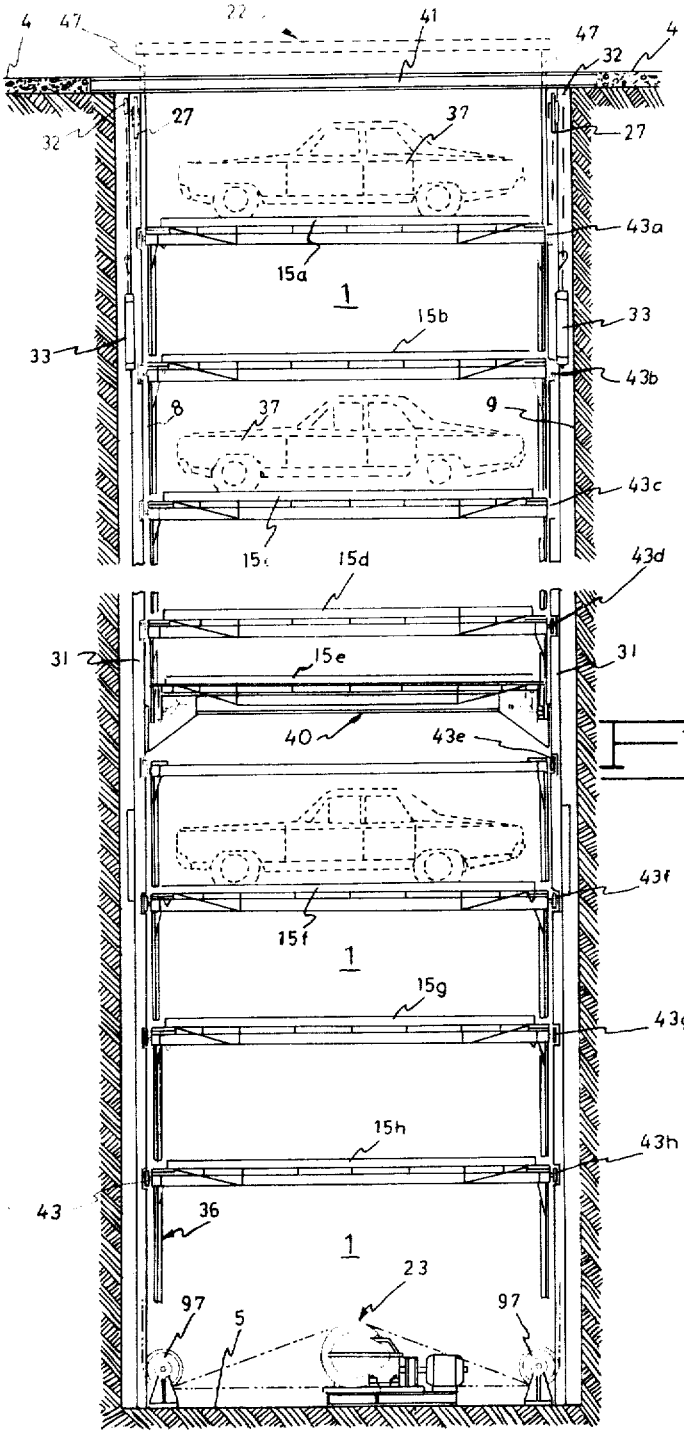
FIG. 2 is an elevational side cross-sectional view similar to FIG. 1, taken at an angle of 90° with respect thereto.

Having now more particular reference to the drawings, and more specifically to FIGS. 1 and 2 thereof, the underground automatic parking system for vehicles built in accordance with the present invention comprises a well 1, preferably of a rectangular cross-section, dug down from the floor or ground level 2 and partially covered, for example, by the side-walk 3 of floor 2 and by the pavement 4 of the traffic lanes of a street in order to leave an access opening. Well 1 is built with a flat bottom 5 and side walls 6, 7, 8 and 9, such as clearly illustrated in FIGS. 1 and 2 of the drawings and provides sufficient area to form a central elevator shaft generally indicated by means of reference character 20, to permit the transit of an elevator 40, and two side compartments 18 and 19 extending throughout the height of well 1, and intended to accommodate, within parking spaces 13*a* to 13*h* and 14*a* to 14*h*, for instance, arranged at several levels 12A to 12H, the vehicles 37 in accordance with what will be more fully described hereinbelow.

Well 1 of the parking system in accordance with the present invention is divided along its height into a plurality of parking levels 12 such as those illustrated by reference characters 12A to 12H in each of FIGS. 1 and 2 of the drawings and, at each level 12 it comprises two parking spaces 13 and 14 for parking vehicles as clearly illustrated in FIG. 1 of the drawings, in the manner of a plurality of parking spaces 13*a* to 13*h* corresponding to compartment 18 and to each one of the parking levels 12A to 12H, as well as of a plurality of parking spaces 14*a* to 14*h* corresponding to compartment 19 and also to each of the parking levels 12A to 12H.

In each one of the parking spaces 13*a* to 13*h* of compartment 18 of well 1, there is a corresponding platform 15, such as those illustrated by means of the particular reference characters 15*a* to 15*h*, arranged on a corresponding supporting slide 16, such as those illustrated by reference characters 16*a* to 16*h* in FIG. 1 of the drawings. Of course that in each one of the parking spaces 14*a* to 14*h* of compartment 19 of well 1, there is an identical plurality of platforms 15 and supporting slides 16 in a symmetrical arrangement, which are otherwise identical to those already described in connection with compartment 18, whereby there is no need of describing them in any further detail.

The supporting slides 16, as will be more fully described hereinbelow, slide on corresponding pairs of channel-like tracks 39, such as those illustrated by reference characters 39*a* to 39*h* in FIG. 1 of the drawings, with a track 39 being arranged at each side of each supporting slide 16 in accordance with what will also be more fully described hereinbelow. The supporting slides 16 and their associated platforms 15 can be displaced into and out of the parking spaces 13, as illustrated by means of dotted lines at level 12E in FIG. 1 of the drawings, by the sole action of elevator 40 through a very simple cam means to be described hereinbelow, said action also removing platform 15 from slide 16 and lifting the same toward the access opening of the elevator shaft 20 in order to introduce or remove a vehicle from the parking system in accordance with the present invention.

At the access opening of the elevator shaft 20 there is a supporting structure 21, 41, on which the cover or lid 22 for said opening is seated, said cover 22 being lifted and lowered by means of a mechanism generally comprising bars or columns 47, 54 which are acted upon by means of a cable 61 engaged to a lug 59 integral with the bars 47, 54 and threaded around a pulley 32 (FIG. 6) rotatably mounted by means of bracket 62 to the structure of members 21 and 41 forming the frame of the access opening, said cable being engaged at its other end to the counterweight 33 (FIG. 1), slidably mounted on tracks 34 for upward and downward movement.

The parking system in accordance with the present invention is provided with a manhole 10 through which access can be had by means of the ladder 11 to the first parking level 12*a*, the parking system being also provided with a general access ladder 24 which extends all the way from the bottom 5 to the top 2, 3, 4 of the elevator shaft 20 such as it can be clearly seen in FIG. 1 of the drawings.

At the bottom 5 of well 1 there is arranged a hoist mechanism generally indicated by means of reference character 23 which, by means of cables 65 and 66, threaded around respective pulleys 26 and 27 rotatorily supported on a frame 25, lifts and lowers elevator 40 to displace the slides 16 from the compartments 18 and 19 to the elevator shaft 20 and back, and to lift and lower the platforms 15, either empty or loaded with a vehicle, to and from the upper or access opening of the elevator shaft 20, at the same time lifting the cover 22 in accordance with what will be described hereinbelow.

The cover or lid 22 of the access opening of well 1 in accordance with the present invention, comprises a frame formed by four similar members 46, 49 on which a cover plate 44 is supported, said plate being provided, if desired, with an anti-skid surface to avoid undue skidding of vehicles continuously moving on the lane 4 of the street at relatively high speeds. Cover 44 is additionally supported by means of reinforcing members 45 of any suitable nature such as will be obvious to any one skilled in the art.

Figure 3:
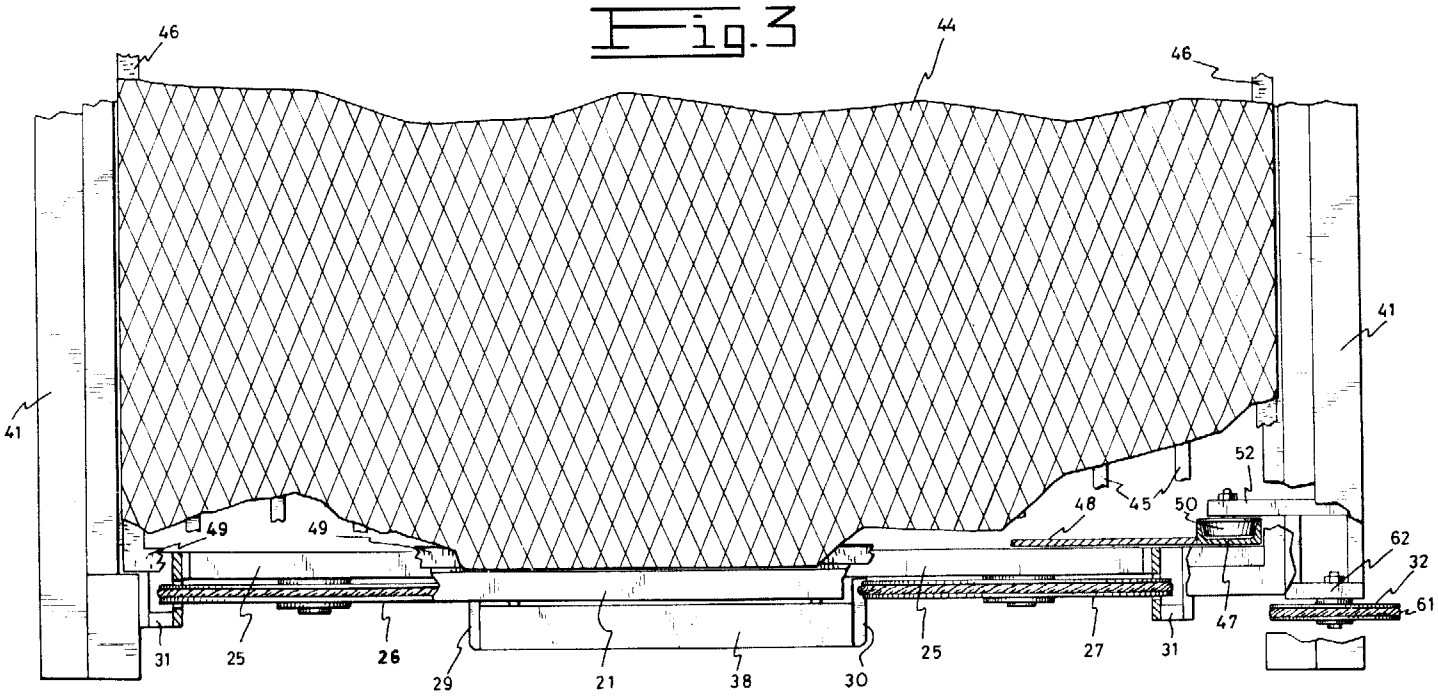
FIG. 3 is a fragmentary top plan view, partly broken away to show inner details, of the cover or lid located at the access opening of the underground parking system in accordance with the present invention.
Figure 4:
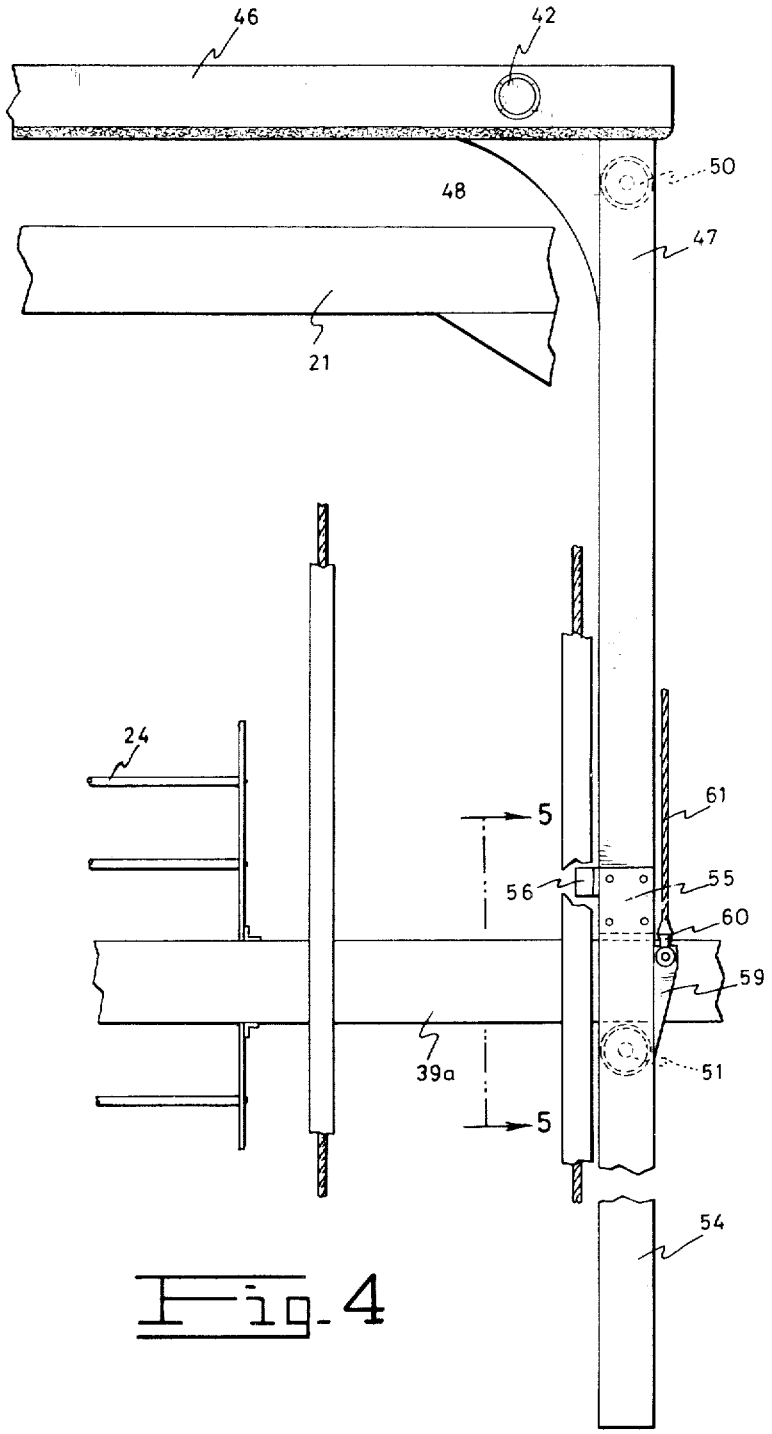
FIG. 4 is a fragmentary side elevational view of the lifting mechanism for the access cover of the parking system built in accordance with the present invention.
Figure 5:
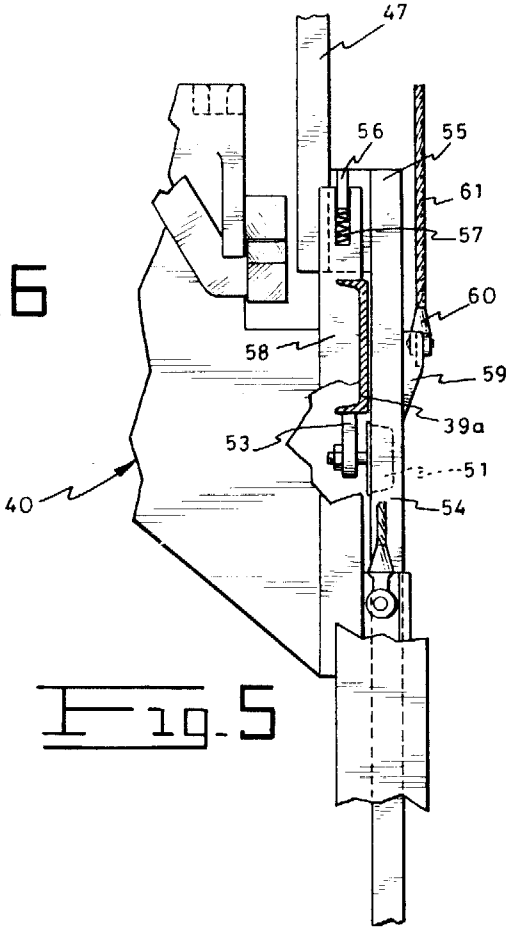
FIG. 5 is a fragmentary cross-sectional view taken along lines 5—5 of FIG. 4 and looking in the direction of the arrows.
Figure 6:
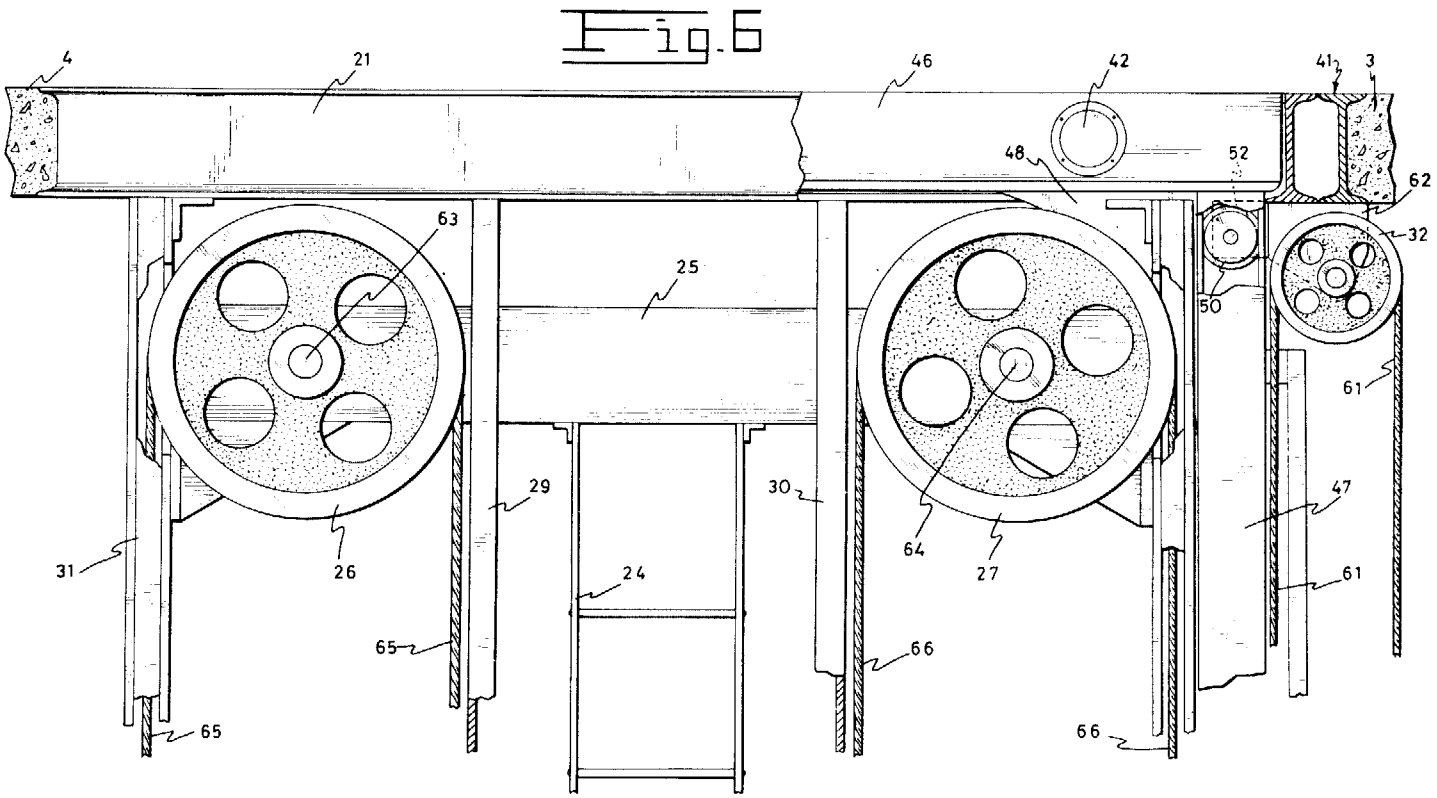
FIG. 6 is a fragmentary front elevational view of the top of the parking system built in accordance with the present invention, showing details of the elevator means and of the access cover of the parking system.
Figure 7:
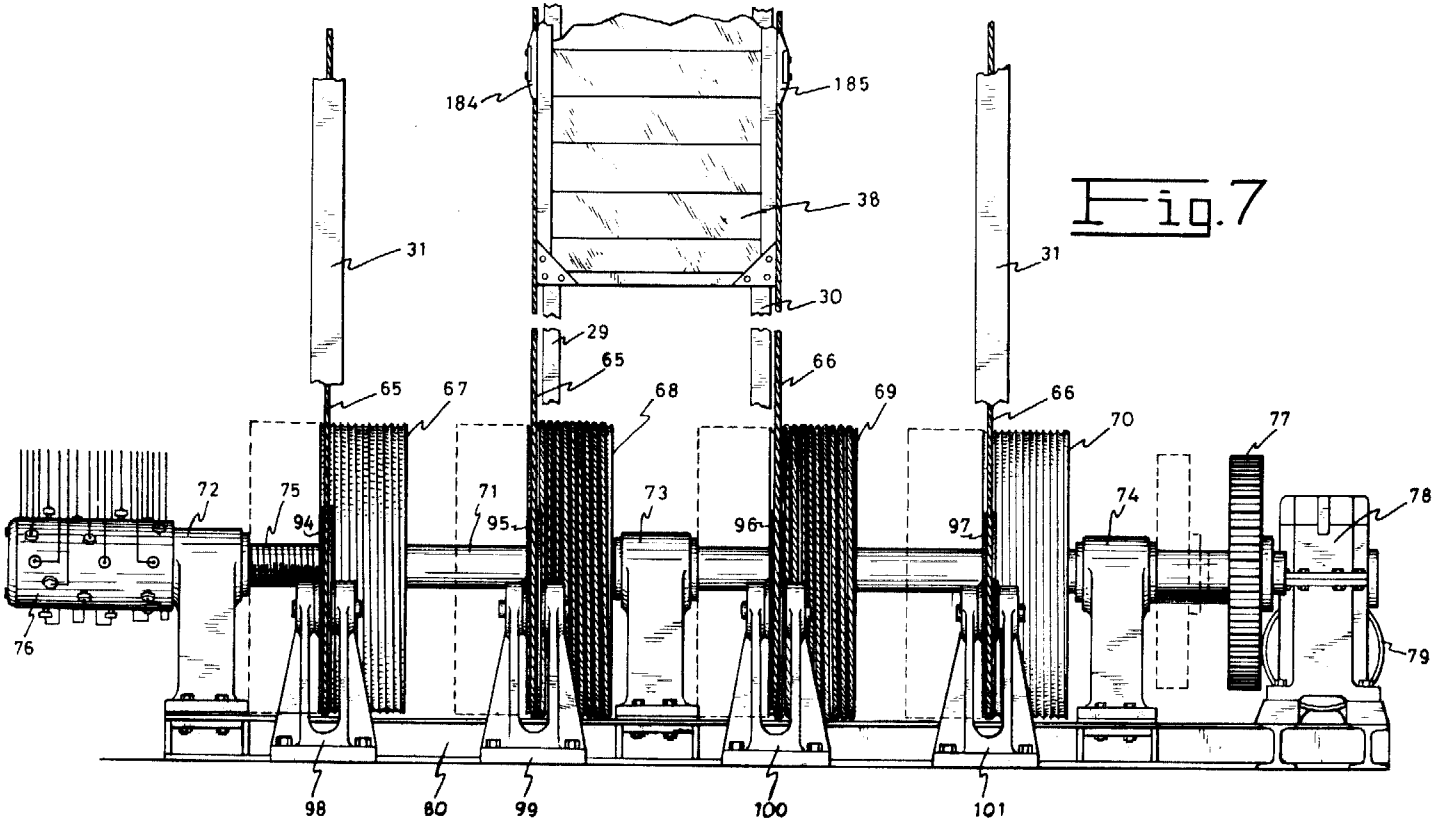
FIG. 7 is a fragmentary elevational view, partly broken away to show inner details, of the hoist means for actuating the elevator means of the parking system in accordance with the present invention.

The pair of members 46 of the frame, as it can be clearly seen in FIGS. 3 and 4 of the drawings, are horizontally arranged at each side of the cover 22 and are attached by means of gusset members 48 to channel-like vertically movable columns or bars 47, guided by a plurality of rollers 50, rotatably supported on brackets 52 which in turn are fastened to the frame 21, 41 of the access opening as it can be more clearly seen in FIG. 6 of the drawings. The channel-like columns 47, one at each end of the cover 22, project downwardly therefrom and are provided at their lower end, each with a pawl 56 which extends into the elevator shaft 20 as it can be seen in FIG. 4 of the drawings. Columns 47 are engaged by a suitable bolted or otherwise fastened coupler 55, to channel-like columns 54, offset with respect to columns 47 to clear the tracks 39*a* within which the supporting slides 16*a* run, columns 54 being guided by rollers 51 rotatably mounted on track 39*a* by means of brackets 53, as it can be clearly seen in FIG. 5.

As the cover 22 ascends and descends upwardly of the ground level 2 adjacent the side-walk 3 and obstructing the traffic lane 4, it becomes necessary to incorporate a suitable traffic light 42 on each of the outer surfaces of the members 46, in order to warn the drivers nearing through the lane 4, that the cover is to be lifted or is already lifted, said traffic lights being also suitably installed at a certain distance on both sides of the access opening in order to warn the drivers in advance that they should drive carefully.

Figures 9, 10, 11:
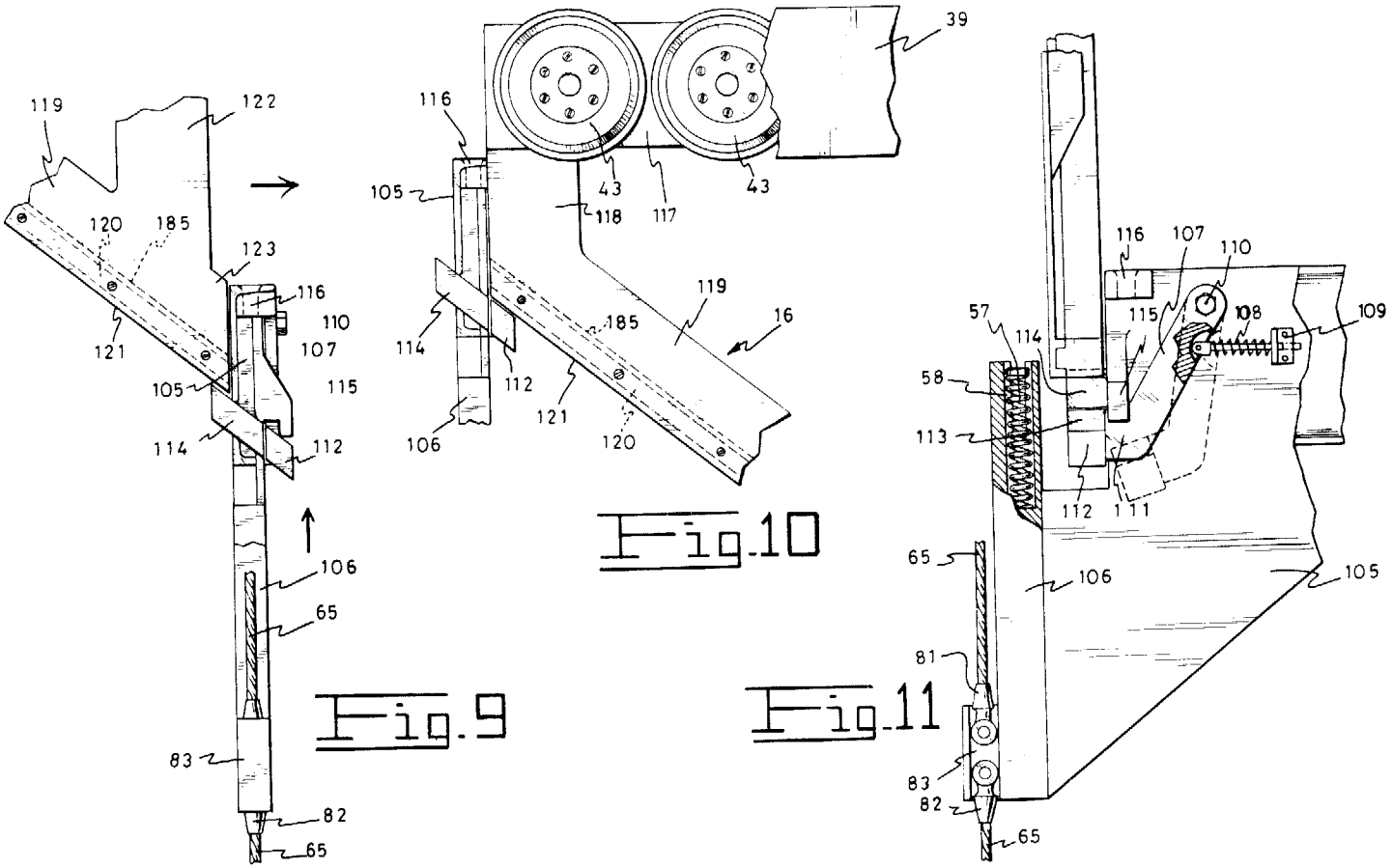
FIG. 9 is a fragmentary elevational view of one of the ends of the elevator means with its side displacing cam means in a position about to be engaged in order to effect displacement of a slide means of the parking system of the present invention.
FIG. 10 is a view similar to FIG. 9 but showing the cam means of the elevator means when the latter has already displaced the slide means of the parking system of the invention to its fully extended position.
FIG. 11 is a fragmentary elevational view, partly broken away to show inner details, of the slide displacing cam means of the elevator means, as well as the cam releasing means of the parking system in accordance with the present invention.

The structure of the cover is lifted and lowered by the shock-absorbing pushers 57 arranged at each one of the ends of the elevator 40 as it can be seen more clearly in FIGS. 5 and 11 of the drawings, said pushers comprising bores 58 within which springs 57 are located, said springs catching the pawl 56 during the ascending movement of the elevator 40 in order to lift cover 22 without undue jarring as it will be obvious to any one skilled in the art. Of course that, as described above, the cover 22 is counterweighted by the counterweight 33 slidably arranged along columns 47, 54 through cable 61 engaged to lug 59 by means of a suitable coupler 60, the other end of cable 61 being attached to the counterweight 33 around pulley 32 as described above.

The elevator 40 moving through the elevator shaft 20 of well 1 of the parking system built in accordance with the present invention, as well as its actuating mechanism including cables 65 and 66 arranged in pairs at the ends of the elevator 40, are clearly illustrated in FIGS. 3, 6, 7 and 8 of the drawings.

Figure 8:
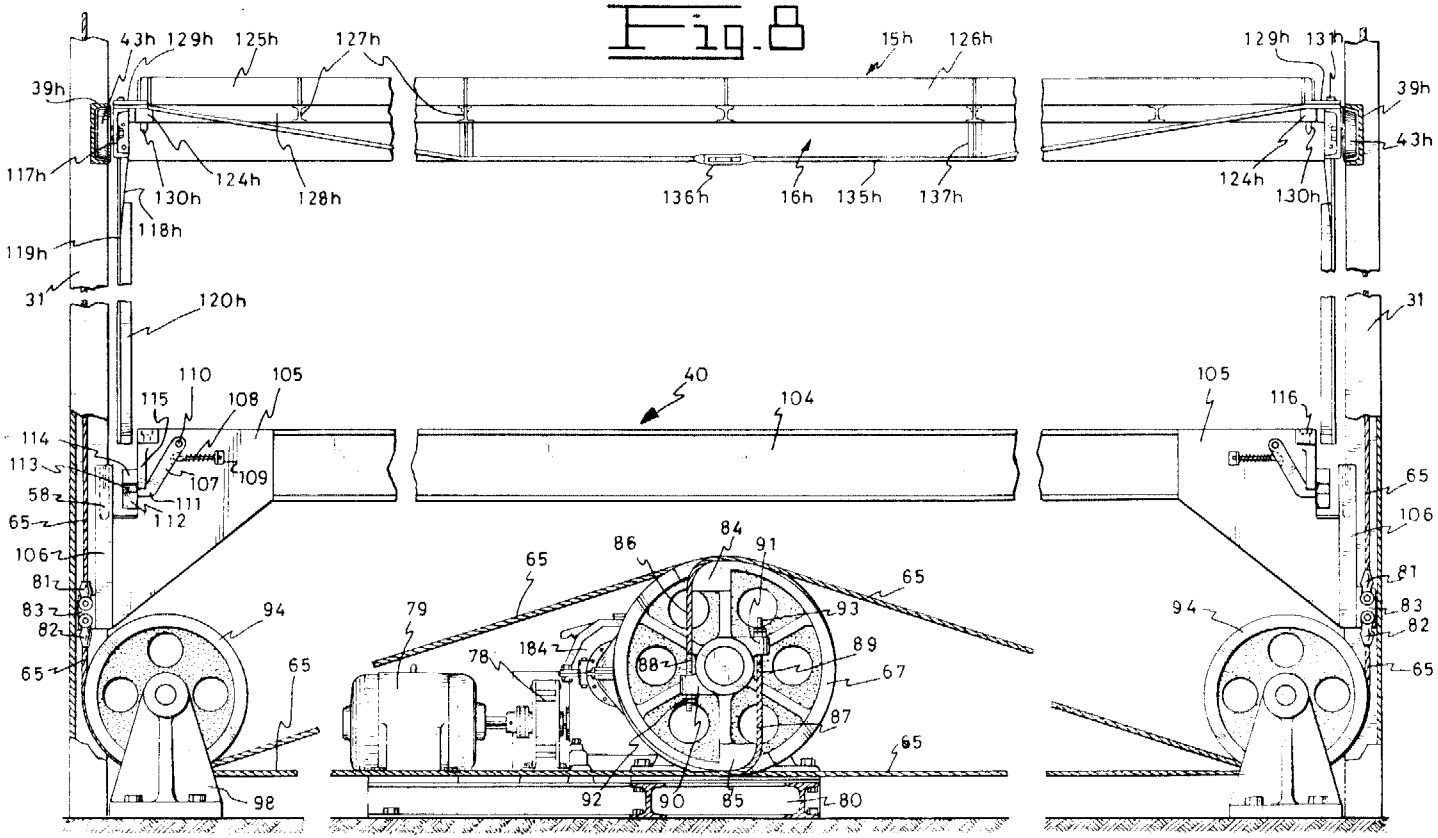
FIG. 8 is a fragmentary elevational view, partly broken away to show inner details, taken at an angle of 90° with respect to FIG. 7, and illustrating the hoist means, the elevator means and one of the vehicle supporting platforms of the parking system in accordance with the present invention.

As it can be clearly seen in FIG. 8 of the drawings, the elevator 40 in accordance with the present invention comprises a pair of beam members 104, (with only one of said members shown for clarity purposes) spaced from each other but arranged to be lifted and lowered in unison at equally leveled positions. Inasmuch as both beam members 104 of the elevator 40 are exactly alike, only one of said members will be described hereinbelow, but under the understanding that one beam member 104 is placed at each side of the elevator 40 on the vertical end planes of the elevator shaft 20, one as shown in FIG. 8 and the other at the opposite side. Therefore, only the member actuated by cable 65 will be described hereinbelow as it is not considered necessary to describe the other beam member 104 which is actuated by cable 66, inasmuch as both members are symmetrical and otherwise identical.

The beam member 104 is supported by means of two gusset-type triangular plate brackets 104, provided at the ends with vertical guided slides 106, slidably engaged within guiding vertical channels 31 which extend throughout the height of well 1. It is in each of these vertical slides 106 of beam member 104 shown in FIG. 8 where the pushers 57 are arranged, being this the only difference between the two beam members of the elevator, inasmuch as the pushers 57 are only arranged at the end of the elevator 40 which is actuated by means of cable 65, as this type of pushers are not necessary at the other end because the cover of the access opening is only lifted by pushing on one side of the same.

Each one of the slides 106 is provided at its lower end with a sidewardly directed block 83 projecting within channels 31, as it can be clearly seen in FIG. 8. From this block 83 a cable connector 81 depends, which connector engages the upper stretch of cable 65, said cable being directed upwardly alongside of the corresponding channel 31, whence it is threaded around pulley 26 rotatably supported by means of a pivot 63 to the structural member 25 located at the top of the well 1 in accordance with what was described in connection with FIG. 1 of the drawings, to henceforth follow its descending path passing through a coupling 184 integrally engaged on one side of the counterweight 38 which slides within the channels 29 and 30. From the coupling 184, cable 65 is threaded around pulley 95 rotatably mounted on the stand 99 and hence to drum 68 on which grooved surface it is threadably supported, as clearly illustrated in FIG. 7 of the drawings. At its opposite stretch, cable 65 is engaged by means of a cable connector 82 engaged by the block 83 of the vertical slide 106 and hence it is threaded around pulley 94 supported on the stand 98, and enters into the drum 67 around a guiding block 85 which permits the cable 65 to bend at a substantially straight angle to form a radial stretch 87 having a threaded end portion 89 to form a screw member 93 which is engaged by means of a nut assembly to a tangential bracket 91 supported on the hub of the drum 67 in accordance with FIG. 8 of the drawings.

As regards the other cable 65 which is at the opposite end of well 1, said cable 65 is also threaded in identical manner around pulleys 94 and 26 arranged at the other side of the well 1 and it is also engaged to drum 67 around a block 84, threaded end portion 88 and nut assembly 92 through the tangential bracket 90 of the drun hub 67. In this manner, both cables 65, that is, one at each side of the beam member 104 of the elevator 40 are lifted or lowered by means of drums 67 and 68.

As to the other member 104 for the elevator 40 of the present invention, this is actuated by means of a cable 66 which is threaded in exactly the same manner from drum 70 around pulley 97 supported on stand 101, around pulley 27 rotatably supported on a pivot 64 engaged to the structural member 25, through a coupling 185 which is integrally attached to the counterweight 38 on the other side thereof, pulley 96 supported on the stand 100, and hence to drum 69, to act exactly in the same manner as cable 65 previously described.

All the drums indicated by means of the reference characters 67, 68 69 and 70 of the hoist system are mounted on a common shaft 71 which is journaled on bearings 72, 73 and 74, said shaft being driven through gear 77, by means of the speed reducing mechanism 78 which is acted upon by motor 79. Shaft 71 is provided with a brake, preferably of the electromagnetic type, indicated in FIG. 8 of the drawings by means of reference character 184, motor 79 preferably being a two-speed reversing-action motor in order to rotate in any of the two opposite directions and in any of two speeds to be capable of moving the elevator 40 of the parking system built in accordance with the present invention up and down and at two different speeds of travel.

All pulleys 94, 95, 96 and 97 which guide cables 65 and 66 toward and away from drums 67, 68, 69 and 70, respectively, are mounted on the floor 5 of well 1, by means of a base member 80 to fixedly support the hoist system and the motor. Therefore, in order to enable the cables 65 and 66 to be suitably threaded through the helical grooves of the above mentioned drums, shaft 71 is provided with a threaded end 75 having a pitch exactly identical to the pitch of the cable groove of each drum, said threaded end 75 of shaft 71 being operated within a complementary internally threaded journal or stand 72 in order to have the shaft 71 sidewardly displaced upon rotation thereof so that the drums 67, 68, 69 and 70 may be also sidewardly displaced to the positions indicated by dotted lines in FIG. 7 of the drawings, whereby the cable will aways be aligned with the cable groove of each drum without the need of providing a plurality of movable guiding pulleys as it was customary in the hoists of the prior art.

At the end of shaft 71, a commutation device 76 is provided in order to command all the sequential operations of the elevator of the present invention as will be clearly apparent to any one skilled in the art.

The platform supporting slides 16 built in accordance with the present invention, which support thereon the platforms 15 which in turn support thereon the vehicles 37 in accordance with what was described in connection with FIGS. 1 and 2 of the drawings, are illustrated in full detail in FIGS. 8 to 11. As it can be seen in said Figures, each of said supporting slides 16 comprises a rectangular upper frame which side members or headers 117, one at each side of the frame, are provided with a plurality of rollers 43 along the same, said rollers being accommodated to roll within the channel-like tracks 39 located at each level 12 of the well 1 of the parking system in accordance with the present invention. Thus, the supporting slides 60 are capable of a guided sideward movement from a retracted position illustrated in full lines in FIG. 1 of the drawings, to an extended position illustrated by dotted lines in said Figure. Each member 117 of the slide 16 is provided with an actuating device consisting of a triangular shaped frame which comprises a vertical member 118 depending from the end of the horizontal member 117 which is nearest to the side wall 6 or 7 of well 1, and is continued at its lower end by an inclined member 119 which extends beyond the projected termination of the header 117, thus forming a projection 123 (FIG. 9) for a purpose which will be clearly apparent hereinbelow. At the opposite end of member 117 an integral vertical member 122 is arranged with its upper end integrally attached to said member 117 and its lower end integally attached to the inclined member 119 to complete the triangular frame of the supporting slide, such that the projection 123 of the inclined member 119 is directed toward the center of the well 1, that is, toward the elevator shaft 20 of said well. The triangular frame can be completed by a plurality of vertical reinforcing members such as clearly illustrated in FIG. 1 of the drawings, in order to give sufficient stiffness to the structure.

The inclined member 119 is provided at its lower edge with a flange 120 which may be integrally formed with member 119 or which may be attached thereto by any other means such as bolts, screws or similar fastener devices, such that a lower inclined plane cam surface 121 and an upper inclined plane cam surface 185 are provided, both of which cooperate with the corresponding upper and lower surfaces, respectively, of a slide displacing cam 114 integrally formed at the end of each of the gusset type brackets 105 of the beam members 104 of elevator 40. The slide displacing cam 114 comprises a cam releasing pawl member 112 which is similar to member 114 and is colinearly arranged therewith at the end threof directed toward the elevator shaft 20. The complementary pawl member 112 is formed as an inclined cam block forming upper and lower cam surfaces parallel to cam surfaces 121 and 185 of the inclined member 119 of the slide 16, said cam block 112 being attached to the end of a lever 107 pivotally mounted by means of a pivot pin 110 on the bracket 105 of the elevator, lever 107 being permanently biased towards a position in which cam blocks 112 and 114 are colinear, by means of a spring 108 concentrically arranged about a shank and supported on a lug 109 also attached to the bracket 105 of the elevator 40. The extreme extended position of he lever 107 is limited by a stop 115 against which the upper surface of lever 107 abuts in a position such that cam blocks 112 and 114 are colinearly arranged to each other.

The supporting slides 16 are normally in a hooked or engaged retracted position provided for by an engaging and disengaging mechanism which will be described hereinbelow in full detail in connection with FIGS. 15 and 16 of the drawings, said retracted position of slides 16 being such that all of the members 119 and its projection 123 are fully introduced within the limits of compartment 18 or 19, as the case may be, but such that they can be released by said engaging and disengaging mechanism of FIGS. 15 and 16, in order to carry the slide to an extended position such as that illustrated in FIG. 9 of the drawings. In this released or extended position, the supporting slide 16 is displaced toward the center of the elevator shaft 20, with the projection 123 projecting inwardly thereof, whereby it interferes with the path of ascending movement of the slide displacing block 114. In this manner, that is, in the position shown in FIG. 9 of the drawings, if the elevator is ascending, the cam block 114 will catch the projection 123 by engagement of its upper cam surface with the lower cam surface 121 of the inclined member 119 or the slide 16, whereby, when the elevator continues its ascending movement, said cam block 114 will slide on the cam surface 121 of flange 120, thereby displacing the slide 16 toward the elevator shaft 20 until it reaches a position such as that illustrated in FIG. 10. At this moment, the cam surface 121 of the member 119 clears the cam block 114 and pushes the pawl 112 downwardly and sidewardly to clear the flange 120, such that the elevator 40 can continue its ascending movement to carry therewith one of the vehicle supporting platforms 15 as will be described hereinbelow. Once the elevator 40 has reached the access opening of the shaft, the sequence programming circuit which is normally associated with the system of the present invention will command said elevator 40 to descend, whereby the lower cam surface of pawl 112, which is uncapable of upward displacement, engages the upper cam surface 185 of the flange 120 of member 119 of the slide, thus displacing said slide out of the elevator shaft 20 to again place it in an engaged position in which the cam surface 185 clears the cam block 114, permitting the elevator 40 to continue its descending movement upon engaging the slide 16 and its associated platform 15 in the engaged position within a parking space 13.

Each of the vehicle supporting platforms 15 of the parking system in accordance with the present invention, which are supported above the supporting slides 16 at each one of the parking levels 12A to 12H of well 1, is formed by a frame comprising transverse members 127 and longitudinal members 128, the structure being reinforced by means of compression members 137 located underneath at least sone of the transverse members 127, with a pair of stringers 135 extending below said compression members 137, properly stretched by means of turnbuckles 136 to stiffen platforms 15 in order to provide said platforms with sufficient strength to easily support the weight of any desired vehicle to be parked. Each stringer 135 is arranged below the longitudinal side members 125 and 126 of the platform to reinforce the same.

On the above described structure, a metallic plate is arranged, said metallic plate being formed by a central flat section 134, preferably of an anti-skid material, a pair of steep inclined sections 133 at the ends of said central flat section, and a pair of shallow inclined planes 132 at the ends of each of said steep inclined sections 133, with a slope descending toward the ends of the platform such that the vehicles to be parked must first go up the planes 132 to then go down the steep sections 133 until they are parked at the central flat section 134 without any possibility of displacement in case of brake failures. Each platform 15 of the present invention is completed by a pair of guiding angular members 125 and 126 arranged throughout the length of each of the edges of the platform in order to guide the wheels of the vehicles to be parked thereon, such that said vehicles cannot be inadvertently displaced sidewardly out of the platform.

Figure 12:
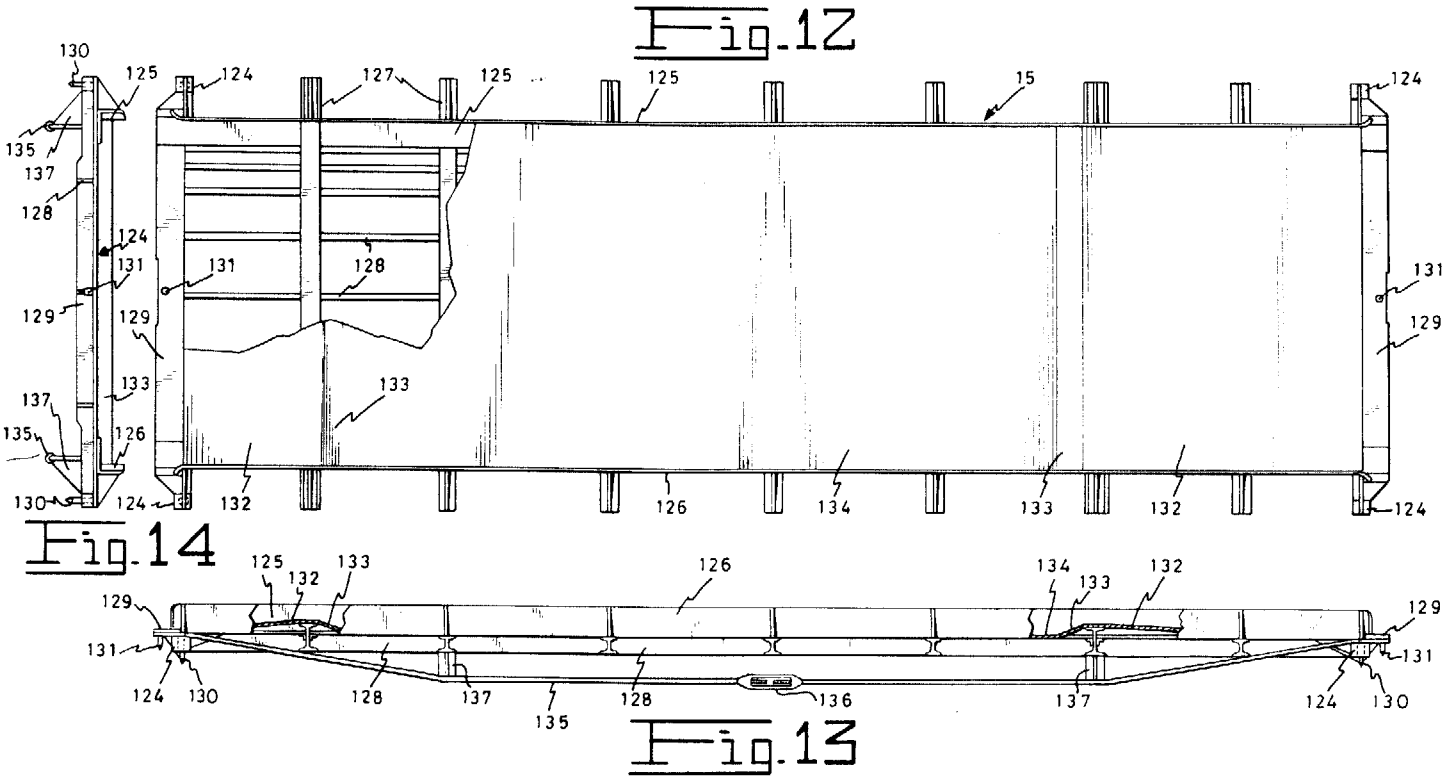
FIG. 12 is a top plan view of one of the vehicle supporting platforms built in accordance with the present invention.

Platform 15 has, at each of its ends, an angular member 129 with side projections 124, with corresponding bolts 130 extending downwardly therefrom, said bolts 130 being received in the complementary bores 116 of brackets 105 of elevator 40 in its ascending movement, so that the platform may be engaged by said elevator 40. At the longitudinal centers of the angular members 129, a plurality of bolts 131 are arranged to extend downwardly therefrom as clearly illustrated in FIGS. 12, 13 and 14 of the drawings, said bolts 131 being received in complementary bores in the members 117 of the supporting slides 16 such that, when the elevator descends carrying a platform 15 thereon, said bolts 131 are accurately received within said complementary bores of members 117 to remain suitably centered on the members 117 once the platform 15 is bearing on members 117 through the angular members 129.

In this manner, when the platform is placed in the position shown by dotted lines in FIG. 1 of the drawings, in view of the sideward displacement of the supporting slide 16, as was previously described, which displacement is effected by the action of elevator 40 proper, said elevator 40 carries platform 15 therewith, centering the same on each one of brackets 105, by means of the engagement of bolts 130 into bores 116 in order to support the platform thereon in its ascending movement. When the elevator descends, it firstly leaves the platform supported on the headers 117 of the slide 16, by means of the angular members 129 of the platform, centering the position of said platform on the slide 16 by means of the engagement of bolts 131 into the corresponding complementary bores.

As mentioned above, the slides 16 are operable between an engaged position within any of compartments 18 or 19, which completely clears the elevator shaft 20, in order to enable the elevator 40 to ascend and descend freely therethrough, and a disengaged position, which introduces the projection 123 of the slide 16, into the path of movement of the elevator 40, in order to be engaged thereby. The shift of the slide 16 between the engaged and the disengaged positions, is effected by means of the mechanism clearly illustrated in FIGS. 15 and 16 of the drawings, the automatic parking system of the present invention containing a retaining mechanism for each side member 117 of the slides 16 at each parking level 12 of the well 1.

Figure 16:
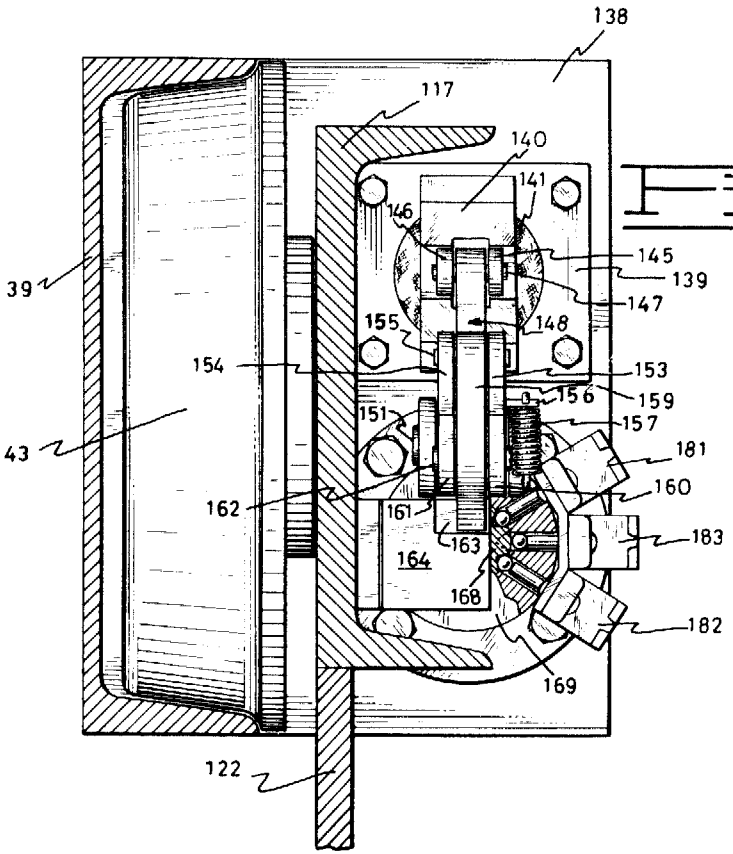
FIG. 16 is a cross-sectional elevational view, partly broken-away to show inner details, taken along lines 16—16 of FIG. 15 and looking in the direction of the arrows.
Figure 15:
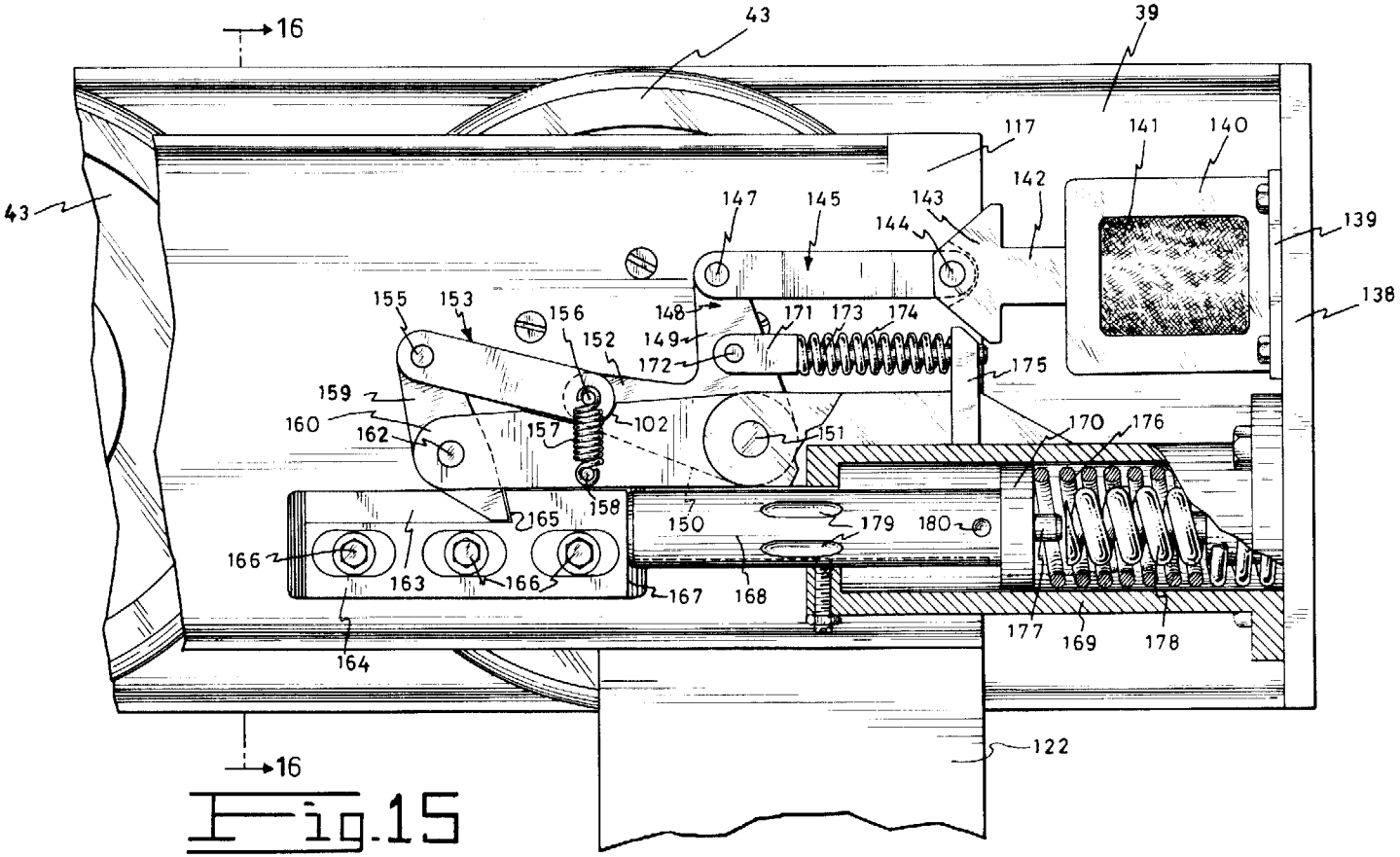
FIG. 15 is a fragmentary elevational view, partly broken away to show inner details, of the side retention means associated with one of the parking spaces of the parking system in accordance with the present invention.

The engaging or retaining devices of the platform supporting slides 16 of the parking system in accordance with the present invention are clearly illustrated in FIGS. 15 and 16 of the drawings, and it can be seen in said drawings that the channel or track 39 guiding the rollers 43 of the structural members 117 of the slides 16, is provided with a perpendicular flange 138 serving as as a support for the retaining device. On said flange 138, the base member 139 of a solenoid 141 wound on a frame 140 is mounted, said solenoid being provided with a movable core 142 which has an end 143 in which extremity a cavity is arranged, a bolt 144 being inserted therein to support the link 145 engaged at its opposite end, through a pivot bolt 147, to a force amplifying mechanism which comprises a toggle 148 having an upstanding arm 149 pivoted to the link 145, said toggle 148 being pivotally supported on a bolt 151 at the angle portion thereof and engaged at its other arm 152 to a tween link 153, colinear with the arm 152 of toggle 148, and pivotally engaged therewith by means of a pivot bolt 156. At the other end of the link 153, through a pivot bolt 155, a hook member 159 of the engaging device is mounted, said hook member being downwardly directed such that, in its hooking position shown in FIG. 15 of the drawings, it will have its end introduced within a cavity 163 and engaged to a complementary shoulder 165 of a hooking block 164 firmly attached to each header 117 of the supporting slide 16 of the present invention. At a point intermediate the hook member 159, a tween rocker 160 is pivotally engaged by means of a bolt 162 to said hook member 159, said rocker 160 being also pivotally engaged to the bolt 151 which also rotatably supports the toggle 148. Rocker 160 has a cavity 102 to receive the lower edge of the link 153 to fix it in the hooking position of the retaining device.

At a point intermediate rocker 160, a bolt 158 is mounted, said point being directly under the pivot bolt 156 which connects arm 152 of toggle 148 and link 153, and a helical tension spring 157 is introduced, with its upper end engaged to bolt 156 and its lower end engaged to bolt 158 for a purpose which will be clearly described hereinbelow.

The movement of the retaining device towards the hooking position is normally forced by the spring 174 mounted around a shank 173 having a coupling 171 which is coupled by means of a bolt 172 to the arm 149 of toggle 148 and which other end bears on a bracket 175 which extends upwardly of a cylinder 169.

Cylinder 169 is directly supported on the flange 138 of the track 39 and contains therewithin a piston 170, forced to its extended position by means of a compression helical spring 176 located within the chamber of the cylinder formed between the base thereof and the piston 170. Piston 170 is integrally engaged to a push bar 168 which free end abuts against the end 167 of the hooking block 164 supported on header 117 of the supporting slide 16 by means of bolts such as 166. The hooking block 164, in turn, is provided with a cavity at its upper edge towards the center thereof, indicated by means of reference character 163, said cavity ending on a shoulder 165 inclined so as to form a locking surface to lock the hook member 159 of the retaining device, such as clearly illustrated in FIG. 15 of the drawings. Within the cylinder 169, there is also arranged a concentric compression helical spring 178 which serves as a shock absorber through its engagement on the flat surface of piston 170 and its aligning with shank 177 which projects therefrom towards the opposite direction of the push bar 168, such that, when the slide 16 is introduced to its engaged position by the elevator 40, as previously described, the inertia of the slide 16 forces the piston 170 and its shank 177 to engage with the shock absorbing spring 178 in order to avoid sharp stops and jarring of the device.

The push bar 168, comprises a cavity 180 which is associated with a limit switch 183 in order to indicate the engaged position of the slides 16. In other words, this cavity 180 and its associated limit switch 183 form part of a safety device, inasmuch as if some of the retaining devices are not in hooked position, that is, if some of the slides 16 is not completely introduced in its engaged position, the limit switch 183 (FIG. 16) will remain outside of its associated cavity 180 and, therefore, will prevent the passage of current, whereby the system will not work in accordance with what will be described hereinbelow in connection with the preferred circuit to operate the present automatic parking system, as illustrated in FIG. 17.

A pair of elongated grooves 179 associated with respective limit switches 181 and 182 (FIG. 16) are also provided on said push bar 168, in order to disconnect solenoid 141 when the slide 16 has been disengaged, so as to reset the retaining device to again engage the slide when it returns to its retracted position.

The performance of the engaging and disengaging device illustrated in FIGS. 15 and 16 is as follows: The sequence logic programming circuit which is normally associated with the sequential systems such as the automatic parking system of the present invention, energizes at a predetermined moment the solenoid 141, whereby bar 142 is pulled towards the right as seen in FIG. 15, pulling therewith the link 145 which in turn, pulls the arm 149 of toggle 148, against the strength of spring 174, thereby dislocating the linearity between its arm 152 and link 153, whereby the distance between bolt 155 and bolt 151 is obviously shortened, causing bolt 155 to be displaced towards the right biasing the hook 159 and, as the inertia of the slide 16, together with its platform 15 and when loaded, jointly with the weight of the vehicle, momentarily forces said slide to remain stationary, the end of the hook 159 is released with respect to shoulder 165 and as at this precise instant the bolt 156 is displaced by the arm 152 of the toggle 148 upwardly, the spring 157, which is tensioned at this moment, pulls up from bolt 158 and, therefore, from rocker 160, thereby instantaneously lifting the hook 159 in order to release the hooking block 164 and the header member 117 of the slide 16. At this moment, the spring 176 within cylinder 169, actuates to bias the slide away from its engaged and retracted position, at the same time as limit switch 183, in accordance with what was described before, deenergizes solenoid 141, returning the hook 159 to its normal position, whereby the same will be ready to receive and engage the slide 16, which engagement is again effected when said slide 16 is pushed by the elevator 40, as described above, causing hook 159 to jump over the hooking block 164 of the slide 16 until it remains in the position shown in FIG. 15 of the drawings, with the slide engaged in its position.

Figure 17:
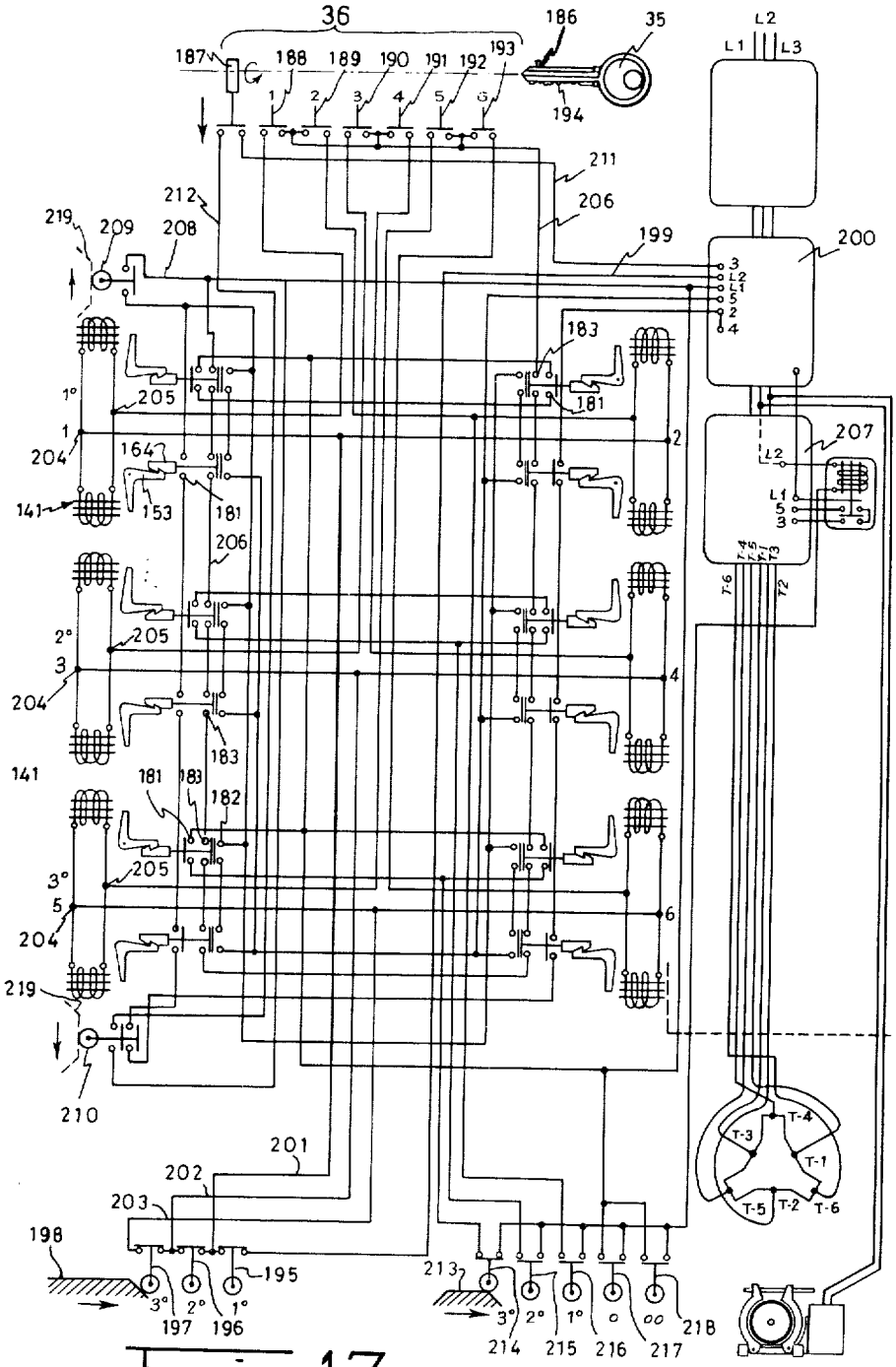
FIG. 17 is a circuit diagram illustrating the preferred sequence programming means for automatic operation of the parking system in accordance with the present invention.

The performance of the automatic parking system of the present invention can be effected with the aid of a programming circuit which can be of any nature, a preferred embodiment thereof being illustrated in FIG. 17 of the drawings.

Basically, the operational sequence of the automatic parking system in accordance with the present invention, is controlled by means of a lock such as exemplified in FIG. 17 of the drawings by reference character 36, said lock 36 having therewithin a switch 187 controlled by the revolving cylinder or drum of the lock 36 which is activated by the code edge 194 of a key 35 which is inserted within the lock 36. Also, the lock 36 is provided with a plurality of individual switches, such as the switches 188, 189, 190, 191, 192 and 193, which are individually controlled by a projection 186 of the key 35, the position of said projection 186 on the key 35 depending on the parking space which is requested to be activated by said key 35.

The switch 187 normally serves to energize, when closed, all of the mechanism of the present invention, while each one of the switches 188 to 193 energizes one of the poles of the solenoid 141 of only one parking space, depending of course on the position of the projection 186 of the key 35.

Even when it is not desired to be bound to a particular electric or electronic control system for the automatic underground parking system for vehicles built in accordance with the above description, it is to be pointed out that the preferred embodiment of the invention comprises controlling said parking system by means of said key 35 and lock 36 of the above mentioned nature. The above described switches, however, can control any programming system which can be selected from many devices, such as the one illustrated in FIG. 17, but which can also be of a completely diverse nature as it will be apparent to any one skilled in the art.

When one of the solenoids 141 corresponding to one of the parking spaces 13 or 14 (FIG. 1) is activated, and assuming that it is desired to park a vehicle in the parking space activated by means of one of the switches 188 to 193, the programming circuit will firstly energize elevator 40, at the same time as the corresponding slide 16 is disengaged, whereby the elevator, when ascending, will pull it out, will trap the corresponding platform 15 and will ascend up to the access opening of the elevator shaft 20, thereby raising the cover 22, such that the owner of the vehicle can introduce his vehicle until the same is within the central portion 134 of the corresponding platform 15.

Then, the owner of the vehicle will remove the key 35 from the lock 36, whereby, by means of the above mentioned programming circuit, the elevator will be lowered to trap the slide 16 previously pulled out from its place, depositing thereon the corresponding platform 15 and displacing the same sidewardly until it is engaged in its place by the retaining means. Then the elevator will continue its descending trip down to the bottom of the shaft 20 of the well 1, whereby the operation cycle is completed.

If it is desired to remove an automobile from the parking system, the owner of the same will also energize the solenoid 141 corresponding to the parking space 13 where the automobile 37 is parked and at the same time the elevator will go up in order to trap the slide 16 and its platform 15 already disengaged, whereby the platform 15 and vehicle 37 will be raised until the latter is placed at the level of the access opening of shaft 20, whence the owner of the automobile may remove his vehicle from the platform 15, also removing his key 35 from the lock 36, with which the operation will be reversed and the empty elevator 40 will descend, trapping the slide 16 previously pulled out, depositing thereon the corresponding platform 15 and displacing said slide 16 until it is again engaged in its place, whereupon the elevator 40 continues its descending motion down to the bottom of the shaft.

As a last possible program, the programming system may be capable of energizing the mechanism such that it can simultaneously effect the operation of introducing a vehicle and, taking advantage of the same trip of the elevator 40, also removing another vehicle from the parking system, as long as the owner of the second vehicle will introduce his key 35 before the elevator 40 reaches the bottom of the well, but after the owner of the recently introduced or first vehicle removes his key 35 from the lock 36. In such a case, the vehicle which was introduced will be lowered by the elevator 40, and if its parking space is above that which was selected for the vehicle to be removed, then the programming circuit will not energize solenoid 141 of the parking space corresponding to the vehicle to be removed, until the elevator has gone down to a position lower than the level corresponding to the second vehicle.

Once the introduced vehicle has been properly deposited, the elevator will continue to descend and immediately upon passing through the level of the second selected vehicle, will be reenergized in order to go up and effect the removal operation of the vehicle such as previsouly described.

If the parking space of the second selected vehicle is above the first, then the programming circuit will be capable to, once deposited the first vehicle, raise the elevator and energize solenoid 141 corresponding to the second selected parking space, when said elevator has already introduced the first platform in the firstly selected level. After effecting the above, the cycle is repeated in strict accordance with the above.

As any one skilled in the art will be able to see, numerous programming circuits are available which can be used with the automatic parking system of the present invention, and the circuit of FIG. 17 will only be described as one of many possible circuit embodiments to be associated with said automatic parking system.

In connection with FIG. 17 of the drawings, when the key 35 is introduced in lock 36, the code edge 194 of said key will energize the revolving cylinder of said lock and this will energize the switch 187, closing the same and connecting through lines 211 and 212 and through limit switch 210 and the point 3 of a reversible starter 200 with the line 208 which feeds the current L1 to all the system.

With the above, all of the circuits of the system will be energized for the reception of current L1 provided by the starter 200. At the same time, the projection 186 of key 35 will close, for instance, the switch 188, thereby connecting pole 205 of the corresponding solenoid 141 to line 206, which goes through all the plurality of limit switches 183 of all the parking spaces, jointly forming the safety system thereof. After passing through the safety system formed by the limit switches 183, the line 206 will be directly connected to the line 208 which feeds the current L1. It will be clearly apparent that, if some of the slides 16 are disengaged, that is, if the hooking members 159 and 164 corresponding to a predetermined slide are out of position, then the corresponding switch 183 will remain open thereby cutting the circuit of line 206 to line 208, and the current L1 will not be fed to the pole 205 of solenoid 141 preventing the elevator of the present invention from being energized.

Pole 204 of solenoid 141 is connected through a system of switches 195, 196 and 197 through line 201 to line 199 which feeds current L2 to said device. The switches 195, 196 and 197 are open when the elevator is ascending, by means of the cam 198 which can be incorporated in the commutation device 76 illustrated in FIG. 7, whereby, if the elevator is up, the solenoids which are below the same cannot work in strict accordance with the above. Only when the elevator is at a position lower than the level corresponding to switch 195, 196 or 197, the latter can be actuated and connected through the pole 204 of the corresponding solenoid 141, to the current L2 fed by the starter 200. When the circuit is completed, the platform is disengaged in order to render it ready to be raised by the elevator 40 moved by motor 79 of the hoist in accordance with the present invention.

As motor 79 provided with the system of the present invention is usually of the two-speed type, a cam 213 is provided, for instance, in the commutation device 76 in accordance with the invention, which cam spans two of the switches 214, 215, 216, 217 or 218 in order that, together with the switches 181, the system will detect when the elevator 40 is about to arrive to the place where the platform has been disengaged, inasmuch as the corresponding switch 181, when said platform is disengaged, will be connected closing the circuit to the starter relay 207, in order to deaccelerate the movement of motor 79 before the desired platform is removed. The switches 217 and 218 are provided to deaccelerate the motor when cam 213 spans the same, regardless of the fact that a platform is or is not disengaged, inasmuch as at this time the cover 22 of the elevator starts to be raised, which also needs of a lower speed of the motor.

On the other hand, the brake 184 is also activated by this cam 213, in order to brake the motor 79 when the elevator 40 is reaching a place where a lower speed of the same is required.

The switch 209 is actuated by a cam 219 contained in the elevator 40, in order to cut and automatically brake the movement thereof when it reaches the access opening of the shaft 20. Also, switch 210 actuated by the same cam 219 of the elevator, when the latter reaches the bottom, is opened to cut the circuit formed with the switch 187 and therefore to deenergize the whole of the system of the present invention and leave the elevator properly braked in its rest position at the bottom of shaft 20 of well 1.

It can be seen from the above that an automatic system for underground parking of vehicles has been provided, which system is of very simple performance and of a great safety and will avoid the problems of all the parking systems of the prior art, inasmuch as it is not necessary to drive the vehicles, which instead are automatically placed in the proper parking spaces, with great speed and simplicity.

It is to be particularly noted that any type of programming circuit which may be capable of effecting an operational sequence such as described above, in a similar manner as the circuit illustrated in FIG. 17, can be indistinctly used in association with the automatic underground parking system of the present invention, whereby it is not desired to be bound to any such particular circuit.

Although certain specific embodiments of the present invention have been shown and described, it will be apparent to any one skilled in the art that many modifications thereof are possible, without departing from the true scope and spirit thereof. The invention, therefore, is not to be restricted except insofar as is necessitated by the prior art and by the spirit of the appended claims.

What is claimed is:

1. An underground automatic parking system for vehicles which comprises a vertical well means, said vertical well means being longitudinally divided into two elongated vertical side parking compartments comprising a plurality of parking levels having two parking spaces each, and a central vertical elevator shaft extending between said parking compartments throughout the height of said well means and having an eccess opening at ground level; an elevator means arranged within said elevator shaft; a hoist means engaged to said elevator means in order to move the same between an upward position and a downward position within said elevator shaft; a movable supporting slide means in each parking space, said slide means comprising a rectangular frame supported by two side headers, said side headers having a triangular form with horizontal, vertical and inclined members, said inclined member of said headers comprising a flange having upper and lower inclined plane cam surfaces engageable by cam means arranged in said elevator; a corresponding plurality of vehicle carrying platforms, said platforms being supported on the rectangular frames of said supporting slide means; a pair of horizontal track means arranged along the edges of each parking level of said well means; a plurality of rollers pivotally engaged to each of said headers of the supporting slide means and arranged in rolling relationship with said track means such that the slide means may be horizontally displaced between a retracted position within a parking space and an extended position within said elevator shaft; cam means at each end of said elevator means arranged in a position such that said cam means will be capable of engaging said lower inclined plane cam surface of one of said flanges during the ascending movement of the elevator means, in order to displace a corresponding slide means from its retracted to its extended position; cam releasing means in said cam means to release said lower inclined plane cam surface of said flange during the ascending movement of the elevator means when said slide means reaches its extended position, said cam releasing means being capable of catching said upper inclined plane cam surface of said one flange during the descending movement of the elevator means to cause engagement of said cam means on said upper surface in order to displace said corresponding slide means from its extended position to its retracted position; slide retention means capable of maintaining said slide means in its retracted position fully clearing said elevator shaft and of releasing said supporting slide means and displacing the same a short distance towards said elevator shaft so as to intercept the path of one of said cam means of the elevator means during movement thereof; a vertically movable cover at the access opening of said elevator shaft; cover lifing means in said elevator means for catching said cover and lifting it to a suitable height above the ground level to permit free access of a vehicle into the elevator means; and sequence programming logic means to sequentially effect all the actions of the elevator means and the slide retention means to properly operate the parking system.

2. An underground automatic parking system for vehicles according to claim 1 wherein said elevator means comprises two identical beam members arranged on each side of the elevator shaft and adjacent the inner limits of each side parking compartment, each of said beam members comprising a horizontal beam; a pair of gusset-type plate members, one at each end of said horizontal beam; a vertical slide at each of said plate members; a vertical guiding channel for guiding said vertical slides and arranged throughout the height of the elevator shaft, to accommodate each one of said vertical slides; a pair of pulleys arranged at the top of the elevator shaft to receive respective cables having one end engaged to each of said plate members, the other end of each of said cables being engaged to said hoist means; each one of said cam means at each end of said elevator means being arranged on the said plate members.

3. An underground automatic parking system for vehicles according to claim 2 wherein at least one of said plate members of each beam member of the elevator means is provided with a shock-absorbing pusher to raise the cover means at the access opening the elevator shaft, saida shockabsorbing pusher comprising a vertical bore opening upwardly at one of said vertical slides, a vertical slit sidewardly provided in said bore and resilient means within said bore, so as to receive and catch within said slit a pawl member arranged in said cover means to smoothly raise the cover means therewith.

4. An underground automatic parking system for vehicles according to claim 3 wherein said cover means comprises a rectangular cover plate, a frame to support said cover plate, vertical columns extending from at least two of the corners of said frame; a supporting structure at the access opening of the elevator shaft; guiding means to vertically guide said columns, said guiding means being fixedly supported on said supporting structure, a cable threaded around a pulley pivotally mounted on said supporting structure, one of the ends of said cable being engaged to one of the said columns and the other end of said cable being engaged to a counterweight; said pawl member being located at the lower end of one of said columns in correspondence with the position of the gusset-type plate member in which said shock-absorbing pusher is arranged, said pawl member sidewardly projecting into said bore through said slit, in order to be engaged and pushed by said resilient means.

5. An underground automatic parking system for vehicles according to claim 4 wherein said hoist means to actuate the elevator means comprises a plurality of cable pulling drums rotatably accommodated on a common shaft and having cable guiding helical grooves; reversible two-speed motor means engaged to said common shaft; a plurality of bearings rotatably supporting said common shaft, at least one of said bearings being provided with a helical inner screw-thread actuating on a complementary helical outer screw-thread provided on said common shaft, the pitch of said helical screw-threads being exactly the same as the pitch of said helical grooves of said drums, such that the cable is permanently aligned with said guiding helical grooves when said drums are rotated; each pair of drums being coupled to two pairs of cables, one of which pulls upwardly of said elevator means and the other one of which pulls downwardly of said elevator means; and a counterweight accommodated between two tracks extending all the height of said elevator shaft and engaged to a pair of said cables to counterweight the elevator means.

6. An underground automatic parking system for vehicles according to claim 5 wherein said cam means arranged at the gusset-type plate members of the elevator means and engageable to said inclined plane cam surfaces of the flanges of the headers of the supporting slide means comprise a fixed cam block presenting upper and lower inclined cam surfaces, complementary to the lower and upper cam surfaces respectively of said flange, and a movable cam block, said movable cam block being capable of downward displacement but uncapable of upward displacement and being adapted to snap on said flange during the ascending movement of the elevator means and to fixedly engage said flange during the descending movement of said elevator means, in order to effect the operation of removing said slide means from a parking space towards the elevator shaft when the elevator means is descending and to introduce the same in its parking space when the elevator means is descending.

7. An underground automatic parking system for vehicles according to claim 6 wherein said movable cam block engageable with said flange of the headers of the slide means is engaged to the end of a ratchet means; said ratchet means comprising a lever rotatably supported on at least one of the gusset-type plate members of said beam members, a resilient means normally biasing said lever upwardly and yieldable downwardly to retract said movable cam block, and a stop limiting the ascending movement of said movable cam block for placing the same at a position colinear with said fixed cam block, said movable cam block normally biased by said resilient means to an extended or operational position.

8. An underground automatic parking system for vehicles according to claim 2 wherein said vehicle carrying platforms comprise a horizontal plate, means for guiding the wheels of a vehicle to be parked towards the center of said plate; a reinforcement structure arranged under said plate; and supporting end members to support said vehicle carrying platform on said supporting slide means and on said horizontal beam members of the elevator means, said end supporting members of the platforms being provided with indexing means to engage said platforms in a predetermined position on said slide means and on said horizontal beam members of the elevator means.

9. An underground automatic parking system for vehicles according to claim 8 wherein said indexing means between said supporting end members of the platforms and the slide means comprise guiding bolts vertically downwardly extending from each of said supporting end members, and complementary bores provided in horizontal elements arranged on said side headers of the said supporting slide means.

10. An underground automatic parking system for vehicles according to claim 8 wherein said indexing means between said supporting end members of the platforms and said horizontal beam members of said elevator means comprise guiding bolts vertically downwardly extending from each end of said supporting end members of the platforms and complementary guiding bores provided at the upper edges of the gusset-type plate members of each horizontal beam member of the elevator means.

11. An underground automatic parking system for vehicles according to claim 2 wherein each one of said horizontal beam members of the elevator means actuates the supporting slide means arranged in only one of the side compartments of the well means, while the other of said horizontal beam members of the elevator means actuates the supporting slide means arranged in only the other of said side compartments of the well means.

12. An underground automatic parking system for vehicles according to claim 1 wherein said slide retention means comprise a hooking block engaged to each one of the headers of said supporting slide means; a hook means supported on said horizontal track means; said hook means comprising a releasable hook member engageable to said hooking block; means to disengage said hook member from said hooking block; a shock absorber arranged in the path of movement of each header of the slide means towards its retracted position; and resilient means arranged in said hook means to push on said hooking block when said hook member releases said hooking block in order to sidewardly displace the inclined plane cam surfaces of said flange of said header of the supporting slide means within the path of movement of the elevator means to be actuated by said cam means of said elevator means.

13. An underground automatic parking system for vehicles according to claim 12 wherein said means to disengage said hook member from said hooking block comprises solenoid means actuatable by a switch; a pull bar within said solenoid means; and force amplifying means to permit said pull bar to move within said solenoid means with a force sufficient to enable it to release said hook member from said hooking block upon said force being amplified by said force amplifying means.

14. An underground automatic parking system for vehicles according to claim 13 wherein said force amplifying means comprises a link pivotally attached to the end of said pull bar and colinear therewith; a toggle having a vertical arm engaged to the other end of said link; a second link colinearly engaged to the horizontal arm of said toggle; a hook member pivotally engaged to the free end of said second link; a rocker pivotally supported on the same pivot as said toggle and pivotally holding said hook member at an intermediate point of the length thereof; a tension spring having one of its ends engaged to said rocker at a point intermediate the length thereof and having its other end engaged to the pivot connecting said toggle to said second link, such that, when said toggle is pulled back by said pull bar, said spring is tensioned at the same time as said hook member is released from said hooking block, so that said hook member is snapped off and released from said hooking block.

15. An underground automatic parking system for vehicles according to claim 14 wherein said toggle of the force amplifying means is permanently biased by a compression spring towards the hooked position, such that when the solenoid means is deenergized, said hooking means immediately returns to its hooking position, to receive and retain the supporting slide means in its retracted position when the latter is returned by the elevator means in its descending movement.

16. An underground automatic parking system for vehicles according to claim 1 wherein said sequence programming logic means comprises means for energizing one of the solenoid means corresponding to the selected parking space, in order to release the corresponding slide means; means for energizing the elevator means to cause it to move; means for deaccelerating the movement of the elevator means when the latter is engaged to said corresponding slide means; means for stopping the movement of the elevator means when the latter reaches the access opening of the elevator shaft; safety means to prevent the energization of the system when an unselected supporting slide means is out of its hooked position; and means for carrying the system to deenergized condition when the elevator reaches the bottom of the well means.

17. An underground automatic parking system for vehicles according to claim 16 wherein said sequence programming logic means also includes means for preventing the energization of any second selected solenoid means when a first selected previously energized solenoid means is below the position of the elevator means at a predetermined time, and means for energizing said second selected solenoid means at the instant when said elevator moves downwardly past the position of said first selected previously energized solenoid means or past the position of said second selected solenoid means, depending on which of said first or second selected solenoid means is at a lower level, respectively.

18. An underground automatic parking system for vehicles according to claim 16 wherein said safety means comprises a plurality of limit switches connected in series circuit between a power source means and a starter means for the elevator means, each of said limit switches being associated with each supporting slide means, and said circuit being closed only when all of the said slide means are in their fully retracted position, such that if any slide means of the system is unduly disengaged and out of its fully retracted position, the series circuit will be open and current will not flow through the system whereby it will be fully disabled.

* * * * *